US008439475B2

(12) United States Patent
Katsumori

(10) Patent No.: US 8,439,475 B2
(45) Date of Patent: May 14, 2013

(54) IMAGE RECORDING APPARATUS AND METHOD FOR CONTROLLING THE APPARATUS

(75) Inventor: Toshiharu Katsumori, Tokyo (JP)

(73) Assignee: Olympus Corporation, Tokyo (JP)

( * ) Notice: Subject to any disclaimer, the term of this patent is extended or adjusted under 35 U.S.C. 154(b) by 295 days.

(21) Appl. No.: 12/913,851

(22) Filed: Oct. 28, 2010

(65) Prior Publication Data

US 2011/0109685 A1 May 12, 2011

(30) Foreign Application Priority Data

Nov. 9, 2009 (JP) ..... 2009-256006

(51) Int. Cl.
*B41J 29/393* (2006.01)

(52) U.S. Cl.
USPC ..... 347/19

(58) Field of Classification Search ..... 347/16, 347/19, 37
See application file for complete search history.

(56) References Cited

U.S. PATENT DOCUMENTS 7,207,644 B2 * 4/2007 Kaburagi ..... 347/19
2003/0001918 A1 * 1/2003 Tsuchiya et al. ..... 347/19
2007/0291060 A1 * 12/2007 Aruga ..... 347/12

FOREIGN PATENT DOCUMENTS

JP 2003-048309 A 2/2003

OTHER PUBLICATIONS

Machine English Translation of JP 2003-063115.*

* cited by examiner

*Primary Examiner* — Julian Huffman
*Assistant Examiner* — Sharon A Polk
(74) *Attorney, Agent, or Firm* — Holtz, Holtz, Goodman & Chick, P.C.

(57) ABSTRACT

In at least one of the period when the conveying speed of a continuous record medium is accelerated until the conveying speed reaches a constant speed and the period when the conveying speed is decelerated to stop conveying the continuous record medium, a test pattern is recorded on the continuous record medium by a first image recording unit and a second image recording unit. The pattern is read by a first detection unit and a second detection unit, and a record check unit determines whether or not there is a record error in the test pattern.

13 Claims, 8 Drawing Sheets

IMAGE RECORDING APPARATUS AND METHOD FOR CONTROLLING THE APPARATUS

CROSS-REFERENCE TO RELATED APPLICATION

This application is based upon and claims the benefit of priority of the prior Japanese Patent Application No. 2009-256006, filed on Nov. 9, 2009, the entire contents of which are incorporated herein by reference.

BACKGROUND OF THE INVENTION

1. Field of the Invention

The present invention relates to an image recording apparatus for recording an image by adhering ink etc. to a record medium such as paper, film, etc., and more specifically to an image recording apparatus and a method for controlling the image recording apparatus for detecting a record error occurring when a recording process is performed on a record medium according to image record data.

2. Description of the Related Art

The ink jet system is one of the image recording systems used by an image recording apparatus such as a printer, a FAX, a copying machine, etc. An image recording apparatus in the ink jet system records an image by jetting ink drops from a plurality of nozzles provided in a recording head to a record medium held and conveyed by a conveying device, and can record a high quality image at a high speed.

The image recording apparatus in the ink jet system is widely used in office application such as recording images on a record medium in a cut sheet form. Recently, a number of recording heads have been arranged in an array orthogonal to the conveyance direction of a record medium, thereby improving the throughput, and have also begun to be used in industrial applications such as recording images on a continuous record medium such as roll paper or the like.

Some image recording apparatuses for recording images by adhering ink on a large number of record media record the images while conveying the record media at a high speed of tens through hundreds m/min.

There is the problem with the image recording apparatus in the ink jet system that a head nozzle which jets ink becomes blocked, thereby largely degrading the quality of recorded images. To overcome the problem, there is a configuration of detecting a record error by electronically reading a recorded image and comparing the image with an image represented by the image data transmitted from an upper device.

Especially when a record error is to be detected on the image recording apparatus which uses continuous paper (roll paper), a test pattern is recorded on a record medium after the conveying speed of the record medium reaches a specific speed, the recorded image is read, and a record error is checked. Therefore, a significant volume of wasteful record medium is conveyed until a roil of paper having a great deal of inertia reaches the specific conveying speed, thereby incurring the waste of resources and a high running cost.

In this situation, the apparatus disclosed by the Japanese Laid-open Patent Publication No. 2003-48309 (hereinafter referred to as the patent document 1, and incorporated herein by reference) defines a stepwise variable operation period applied before the target conveying speed of a record medium is reached. Then, a check and an adjustment are made in the variable operation period while the record medium is conveyed at an adjusted constant speed, and when the adjustment is completed, the conveying speed is increased by a specific increment $\alpha$. Afterwards, an operation is performed at a constant speed for a specific number $\beta$ of copies. By repeating the above-mentioned operation while increasing the operating speed up to a practical operating speed, an occurrence of wasteful record medium can be suppressed.

SUMMARY OF THE INVENTION

An image recording apparatus according to an embodiment of the present invention for recording an image on a continuous record medium based on the job information from an upper device includes: an image recording unit for recording a test pattern on the continuous record medium in at least one of a period when the conveying speed of the continuous record medium is accelerated until the conveying speed reaches a constant speed and a period when the conveying speed is decelerated to stop conveying the continuous record medium; a detection unit for reading the test pattern; and a record check unit for determining whether or not there is a record error detected in the test pattern read by the detection unit.

A method of controlling an image recording apparatus according to an embodiment of the present invention for recording an image on a continuous record medium based on the job information from an upper device includes: recording a test pattern on the continuous record medium in at least one of a period when the conveying speed of the continuous record medium is accelerated until the conveying speed reaches a constant speed and a period when the conveying speed is decelerated to stop conveying the continuous record medium; reading the test pattern; and determining whether or not there is a record error detected in the read test pattern.

BRIEF DESCRIPTION OF THE DRAWINGS

The present invention will be more apparent from the following detailed description when the accompanying drawings are referenced.

DESCRIPTION OF THE PREFERRED EMBODIMENTS

The embodiments according to the present invention are described below with reference to the attached drawings. In the descriptions below, the conveyance direction of a record medium is defined as a subscanning direction, and the direction orthogonal to the conveyance direction is defined as a main scanning direction.

Figure 1:
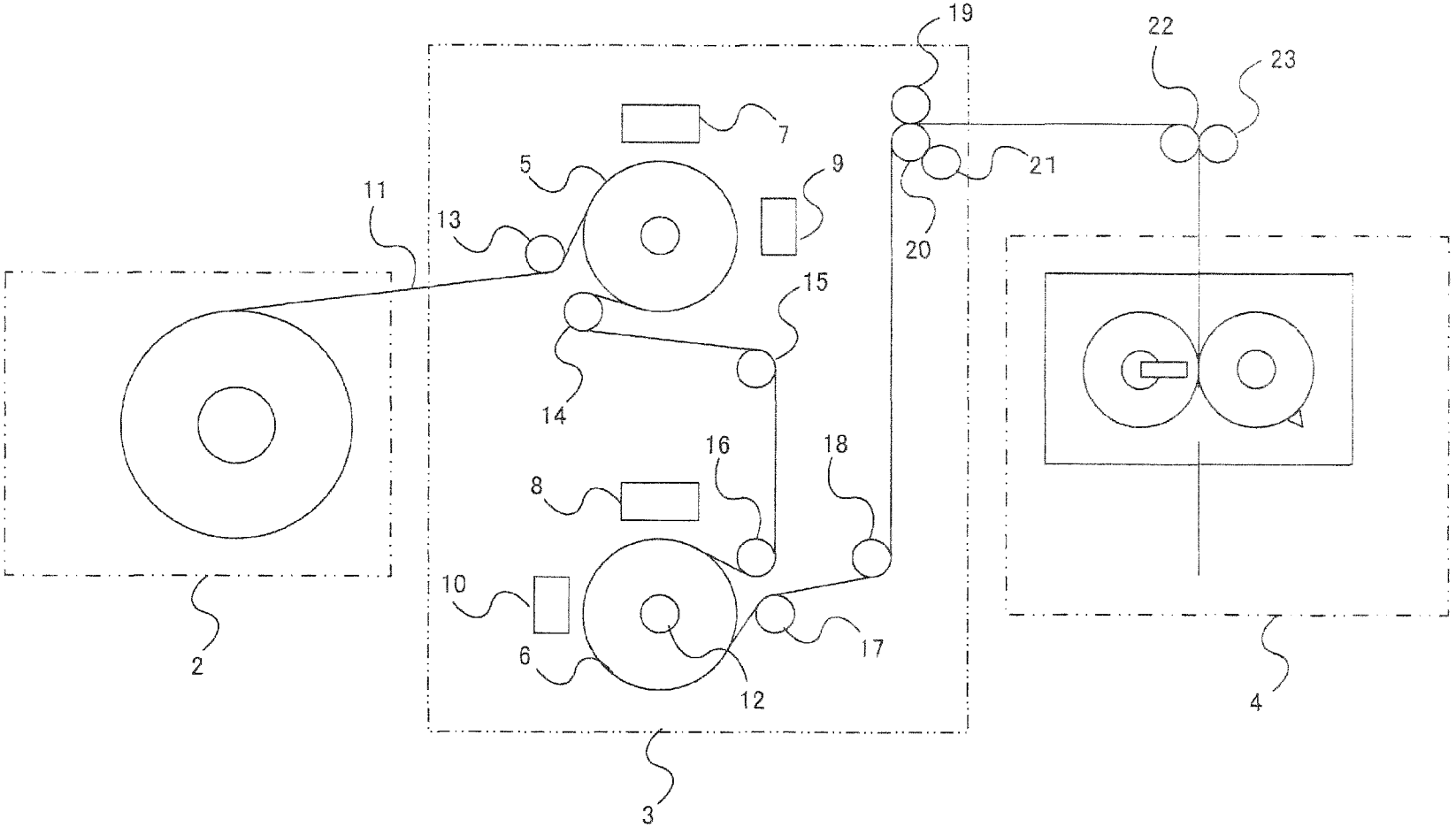
FIG. 1 is a schematic diagram illustrating the arrangement of the image recording apparatus excluding the control unit according to an embodiment of the present invention.
Figure 2:
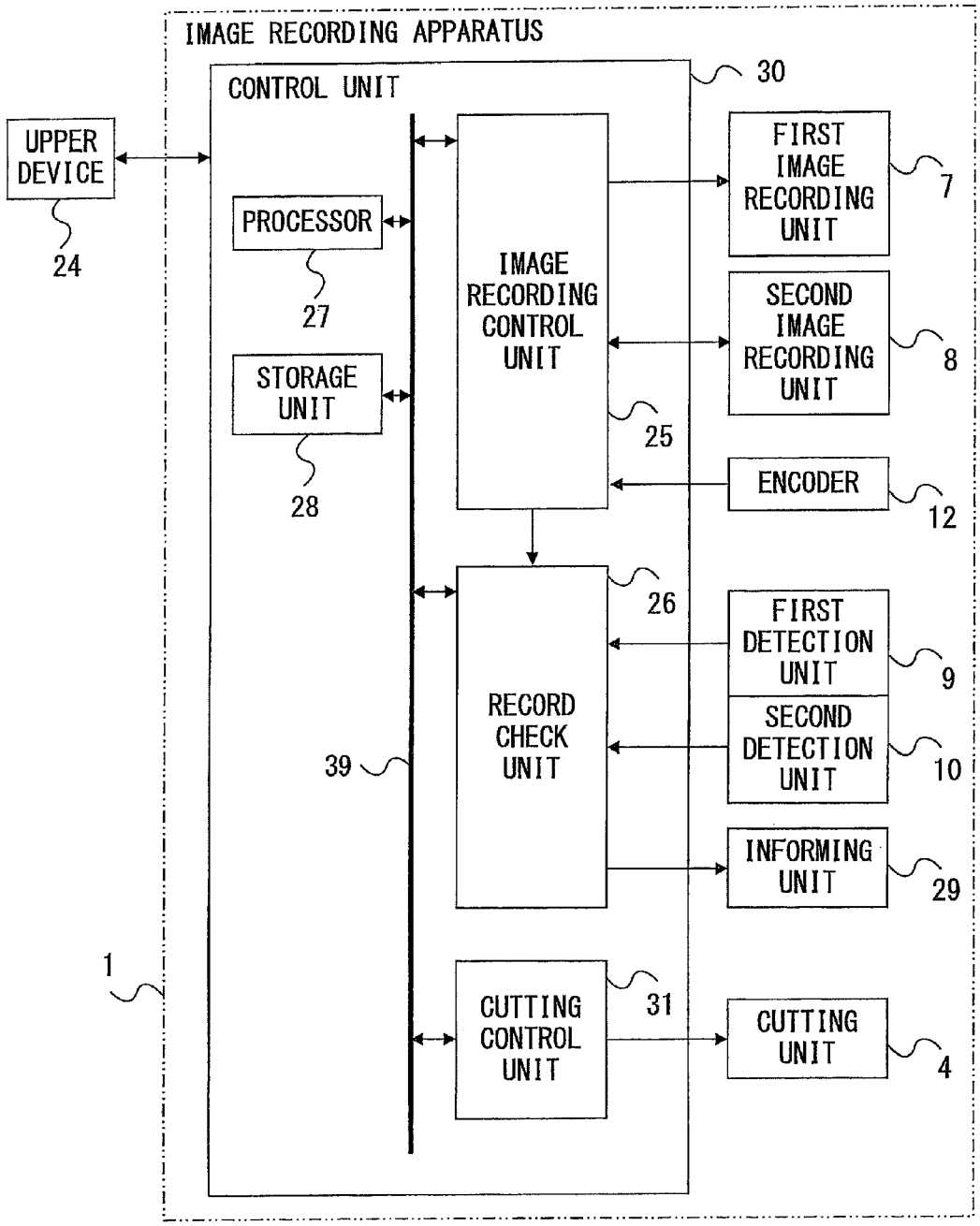
FIG. 2 is a block diagram of the outline of the configuration of the image recording apparatus centering the control unit according to an embodiment of the present invention.

FIG. 1 is a schematic diagram illustrating the arrangement of the image recording apparatus excluding the control unit according to an embodiment of the present invention. FIG. 2 is a block diagram of the outline of the configuration of the image recording apparatus centering the control unit according to an embodiment of the present invention.

The image recording apparatus 1 according to the present embodiment records an image by jetting ink to a continuous record medium such as roll paper etc. based on the image data in the job information transmitted from an upper device 24.

The upper device 24 is connected as external equipment to the image recording apparatus 1 through, for example, a LAN (local area network). The upper device 24 is, for example, a computer operated by a user who directs the image recording apparatus 1 to perform a recording process, and transmits to the image recording apparatus 1 the job information for the recording process.

The image recording apparatus 1 according to the present embodiment includes an unwinding unit 2, an image recording unit 3, a cutting unit 4, an informing unit 29, and a control unit 30. Among them, the informing unit 29 informs a user of an error etc. by display or voice at a direction from the control unit 30.

Described first is the unwinding unit 2.

The unwinding unit 2 stores a continuous record medium such as roll paper etc. for recording images on by the image recording apparatus 1, and provides the image recording unit 3 with a record medium 11.

The unwinding unit 2 has a fixed shaft for supporting the continuous record medium 11 and a unwinding unit stand for supporting the fixed shaft, but they are not illustrated in the attached drawings. The unwinding unit 2 holds the record medium 11 as rotatable by the fixed shaft, and unwinds the record medium 11 to the image recording unit 3.

The unwinding unit 2 has the function of applying back tension in the direction reverse to the conveyance direction of the record medium 11.

Described next is the image recording unit 3.

The image recording unit 3 introduces the record medium 11 conveyed from the unwinding unit 2, winds and holds the record medium 11 by a first drum 5, and conveys the medium to the position immediately below a first image recording unit 7. Then, the first image recording unit jets ink so as to record an image on the record medium. Then, it winds and holds the record medium 11 by a second drum 6, conveys the medium to the position immediately below a second image recording unit 8, records images by the second image recording unit 8 in the same manner as the first image recording unit 7, and then transmits the medium to the cutting unit 4.

The image recording unit 3 is configured by a plurality of free rollers 13 through 18, the first drum 5, the second drum 6, a first detection unit 9, a second detection unit 10, nip rollers 19 and 20, and a nip roller drive unit 21 as illustrated in FIG. 1.

Described first is the conveyance of the record medium 11 in the image recording unit 3.

The record medium 11 unwound from the unwinding unit 2 is conveyed to the first drum 5 through the free roller 13.

The first drum 5 is a hollow cylinder of aluminum. The rotation axis of the first drum 5 is supported as rotatable by the body frame not illustrated in the attached drawings.

The first drum 5 according to the present embodiment can wind the record medium 11 at a winding angle of 330°, and is set to have the perimeter corresponding to three times the length (420 mm) of the size A3 at the winding angle of 330°.

The vertical force is applied to the record medium 11 on the outer periphery of the first drum 5 by the back tension generated from the unwinding unit 2 and by the conveying force from the nip rollers 19 and 20. Then, the record medium 11 is held on the first, drum 5 by the coefficient of the friction between the first drum 5 and the record medium 11.

Next, the record medium 11 is conveyed to the second drum 6 through the free rollers 14, 15, and 16. Like the first drum 5, the second drum 6 is a hollow cylinder of aluminum.

The second drum 6 according to the present embodiment is configured to wind the record medium 11 at the winding angle of 330°, and is set to have the perimeter corresponding to three times the length (420 mm) of the size A3 at the winding angle of 330°. The vertical force is applied to the record medium 11 on the outer periphery of the second drum 6 by the back tension from the second drum 6 at the beginning of winding and by the tension from the nip rollers 19 and 20, and the record medium 11 is held on the second drum 6 by the coefficient of the friction between the second drum 6 and the record medium 11.

An encoder 12 is coupled to the rotation axis of the second drum 6.

The encoder 12 outputs a detection pulse corresponding to the rotation position of the second drum 6, and the pulse is inputted to an image recording control unit 25 of the control unit 30 for driving the recording heads of the first image recording unit 7 and the second image recording unit 8. In synchronization with the detection pulse from the encoder 12, the image recording control unit 25 drives the recording head of the first image recording unit 7 and the second image recording unit 8 and causes the recording head of the first image recording unit 7 and the second image recording unit 8 to jet ink.

For example, a rotary encoder for outputting a signal of 18000 pulses per one rotation of the second drum 6 is used as the encoder 12. It is assumed that the resolution in the conveyance direction of the image record medium is 300 dpi, and 1 dot image is recorded at every pulse of the encoder 12. Thus, when a rotary encoder for outputting 18000 pulses per one rotation is used, the diameter of the second drum 6 is:

$$25.4\ \text{mm} \div 300\ \text{dpi} \times 18000\ \text{pulses} \div \pi = 485\ \text{mm}.$$

In the present embodiment, it is also assumed that the diameter of the first drum 5 is equal to the diameter of the second drum 6. With this configuration, in synchronization with the detection pulse of the encoder 12, the recording heads of the first image recording unit 7 and the second image recording unit 8 may be driven and may jet ink so as to perform the printing at the resolution of 300 dpi in the conveyance direction.

After the end of the roll of the second drum 6, the record medium 11 is held by the nip rollers 19 and 20 through the free rollers 17 and 18.

The nip rollers 19 and 20 have sufficient friction and nip (holding) force to apply a conveying force on the record medium 11. The nip rollers 19 and 20 are driven by the nip roller drive unit 21, and convey the record medium 11 as a result. That is, the conveying speed of the record medium 11 is determined by the driving speed of the nip roller drive unit 21

Since there occurs friction force between the record medium 11 and the first drum 5 and the second drum 6 as described above, the first drum 5 and the second drum 6 are driven and rotated according to the conveying speed of the record medium 11 conveyed by the nip rollers 19 and 20.

All the nip rollers 19 and 20, the record medium 11 is transmitted to the cutting unit 4 through cutting unit introduction rollers 22 and 23.

After images are recorded and the continuous record medium 11 is conveyed from the image recording unit 3, the cutting unit 4 cuts the continuous record medium 11 in the size specified according to the job information from the upper device 24.

Described next are the first image recording unit 7 and the second image recording unit 8. As illustrated in FIGS. 1 and 2, the first image recording unit 7 and the second image recording unit 8 jet ink to the record medium 11 to record images.

The first image recording unit 7 according to the present embodiment has a total of four recording heads for cyan (C), black (K), magenta (M), and yellow (Y) not illustrated in the attached drawings. Each recording head is arranged and secured in a zigzag pattern on the head holding unit not illustrated in the attached drawings. The nozzle surfaces provided at the tip of the recording head are arranged facing the printing surface of the record medium 11 held on the outer periphery of the first drum 5.

The configuration of the first image recording unit 7 is the same as that of the second image recording unit 8.

Described next are the first detection unit 9 and second detection unit 10.

The first detection unit 9 and the second detection unit 10 are provided respectively at the downstream of the first image recording unit 7 and the second image recording unit 8 in the conveyance direction, and read the image recorded on the record medium. The first detection unit 9 and the second detection unit 10 are linear sensors configured by a CCD etc. The images fetched by the first image recording unit 7 and the second image recording unit 8 are input to a record check unit 26 of the control unit 30. The record check unit 26 compares the image according to the job information received from the upper device 24 with the image fetched by the first image recording unit 7 and the second image recording unit 8, and determines the presence/absence of a record error.

Next, the image recording operation on the record medium 11 is described below.

When the image recording operation is started in the image recording apparatus 1 according to the present embodiment, the tension generating operation and the conveying operation are performed on the record medium 11 as described above. When the conveying operation is started, the encoder 12 coupled to the rotation axis of the second drum 6 outputs a detection pulse corresponding to the rotation position of the second drum 6, and the pulse is input to the image recording control unit 25. The image recording control unit 25 records an image on the record medium 11 by the first image recording unit 7 in synchronization with the detection pulse.

Next, in the second image recording unit 8, an image is recorded on the reverse of the image recorded side of the record medium 11 printed in the first image recording unit 7, resulting in images having been recorded on both sides of the record medium 11.

When images are recorded on both sides, a positional registration is required between an image on one side of the recording medium 11 recorded by the first image recording unit 7 and an image on the other side of the recording medium 11 recorded by the second image recording unit 8. The registration is realized by, for example, (1) calculating in advance a number of pulses of the encoder 12 which corresponds to the length of the conveyance path from the record position of the recording head for cyan (C) of the first image recording unit 7 to the record position of the recording head for cyan (C) of the second image recording unit 8, and (2) delaying the starting timing of the image recording operation of the second image recording unit 8 until a count of detection pulses of the encoder 12 which starts at the image recording operation of the first image recording unit 7 reaches the calculated number.

In the present embodiment, the encoder 12 is connected to the second drum 6, but the encoder 12 may be connected to the first drum 5.

The control unit 30 has a processing circuit configured by an MPU (processor) having a controlling function and an arithmetic function, ROM storing a control program, etc. and non-volatile memory not illustrated in the attached drawings but storing a set value etc. about the control of the apparatus. Then, the MUP executes a specific control program and thereby the control unit 30 realizes the controlling processes by the above-mentioned image recording control unit 25 and the record check unit 26, and by a cutting control unit (described later) etc.

The image recording control unit 25, the record check unit 26, and the cutting control unit 31 can not only be realized by software such as execution of a control program by the MPU as described above, but can also be realized by hardware such as a dedicated logic circuit. In this case, the control unit 30 has the configuration of the image recording control unit 25, the record check unit 26, a processor 27, a storage unit 28, and the cutting control unit 31 connected via a bus line 39, as illustrated in FIG. 2.

When the image recording control unit 25 acquires job information transmitted from the upper device 24, it extracts image data from the job information, and then temporarily stores the image data in the storage unit 28 of the control unit 30. The image recording control unit 25 then notifies the first image recording unit 7 of image data in the first line through the n-th line of the image data (n is an integer equal to or larger than 2), thereby starting the recording process.

In the configurations illustrated in FIGS. 1 and 2, a configuration that includes two drums 5 and 6 and two image recording units, that is, the first image recording unit 7 and the second image recording unit 8, is exemplified, but the image recording apparatus 1 according to the present embodiment is not limited to these configurations. The image recording apparatus 1 according to the present embodiment can be configured by a set of a drum and an image recording unit for recording images on one side, or by three or more sets of them. The configuration including three or more sets of a drum and an image recording unit may provide a drum and an image recording unit for each color of ink for recording color images.

In the examples above, the image recording apparatus 1 according to the present embodiment is exemplified as the configuration for recording images by four colors of ink, that is, cyan (C), black (K), magenta (M), and yellow (Y). However, the image recording apparatus 1 according to the present embodiment is not limited to this configuration. The image recording apparatus 1 according to the present embodiment may record images using, for example, three or fewer colors of ink, or five or more colors of ink. In addition, the available colors of ink are not limited to cyan (C), black (K), magenta (M), and yellow (Y).

Figure 3:
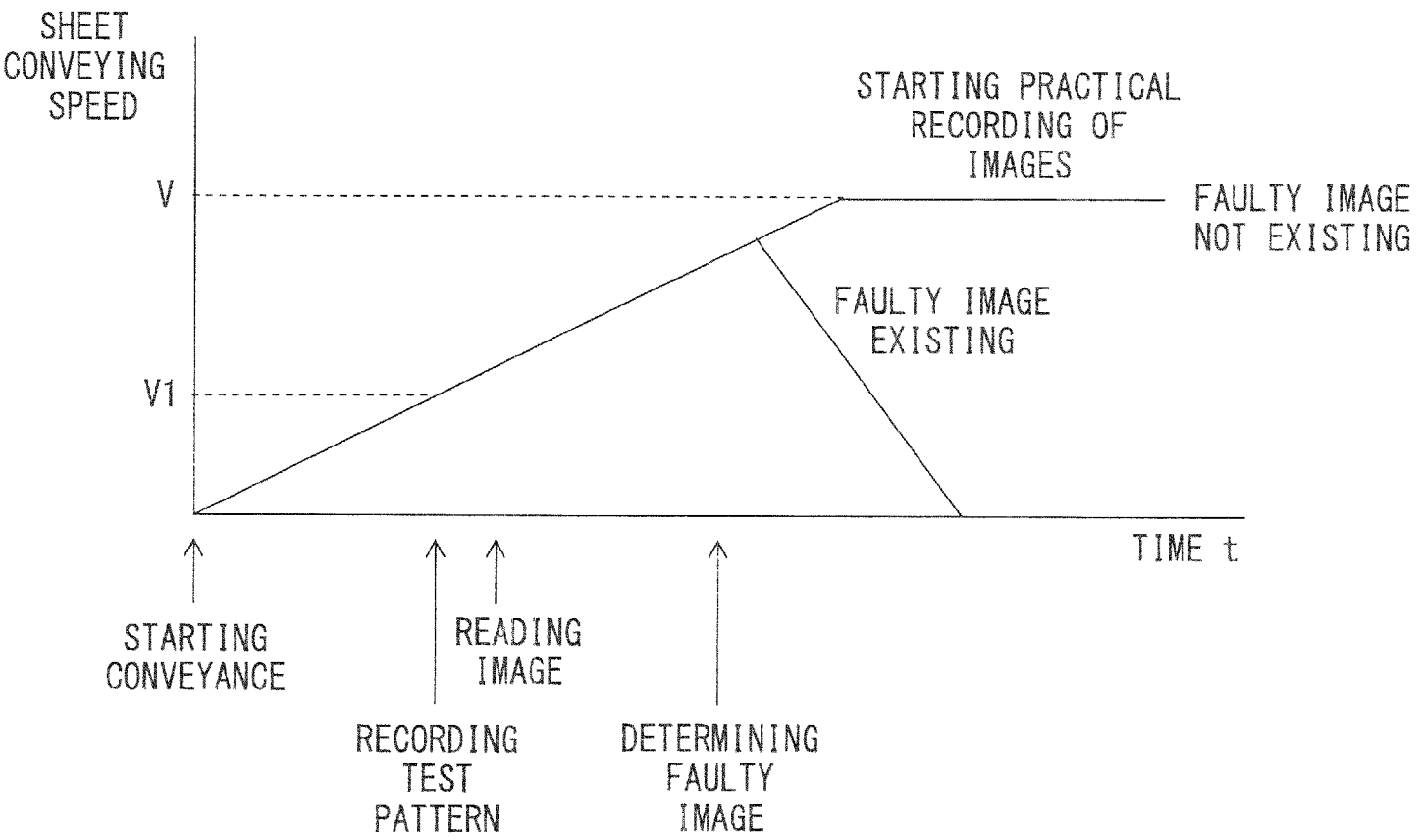
FIG. 3 is an explanatory view of the method of checking a record error on the image recording apparatus according to an embodiment of the present invention.

The method of checking a record error on the image recording apparatus 1 according to the present embodiment is described below in detail with reference to FIG. 3.

First, the conveyance of the continuous record medium 11 is started at the unwinding unit 2 with a specific tension. The conveyance is performed by starting driving of the nip roller drive unit 21, but the record medium 11 loaded on the unwinding unit 2 and the conveyance system can have a great deal of inertia. Therefore, since it is hard to allow the conveying speed to reach a specific conveying speed V (hereinafter referred to as an image recording speed V) appropriate for recording images within a short period of time, the conveying speed is gradually increased to reach the image recording speed V. The record medium 11 conveyed in this time period is normally discarded.

Then, in the image recording apparatus 1 according to the present embodiment, a test pattern for checking a record error is recorded on the record medium 11 during the accelerating period of the conveying speed of the record medium 11, and the test pattern is checked in order to determine whether or not there is a faulty image. If it is determined as a result that a correct image recording process has been performed, a specific image recording operation is immediately performed without a faulty image when the conveying speed reaches the image recording speed V. If it is determined that a correct image recording process has not been performed due to blocked nozzles or the like resulting from the check on the test pattern, the conveyance of the record medium 11 is stopped, and the informing unit 29 notifies the user of an alarm.

Since the first drum 5 and the second drum 6 rotate if the record medium 11 is conveyed as described above, the conveying speed of the record medium 11 is detected from the output of the encoder 12 connected to the second drum 6. When the conveying speed exceeds a specific speed (speed V1 in FIG. 3), the image recording control unit 25 issues an instruction to record a test pattern, and ink is jetted from the nozzle provided for each recording head of the first image recording unit 7. The test pattern is a so-called solid image, and the image may be recorded for each color, or may be recorded by laying colors in a specific area (laid colors).

The conveying speed of the record medium 11 is gradually accelerated after the start of the conveyance until the image recording speed V is reached through a specific speed V1, for example, V1→V2→V3→V3→V4 (V1<V2<V3<V4<V).

In the image recording apparatus 1 according to the present embodiment, an image of a test pattern is recorded during the acceleration. In recording the image of the test pattern, if the density of the ink of the test pattern as a solid pattern is increased, the penetration of the ink into the record medium 11 reaches a saturation level, thereby there is a possibility that the problem of contamination of other parts of the record medium 11 or contamination of the apparatus may be caused. Therefore, in the image recording apparatus 1 according to the present embodiment, the record density is changed depending on the conveying speed when the image of the test pattern is recorded.

Figure 4:
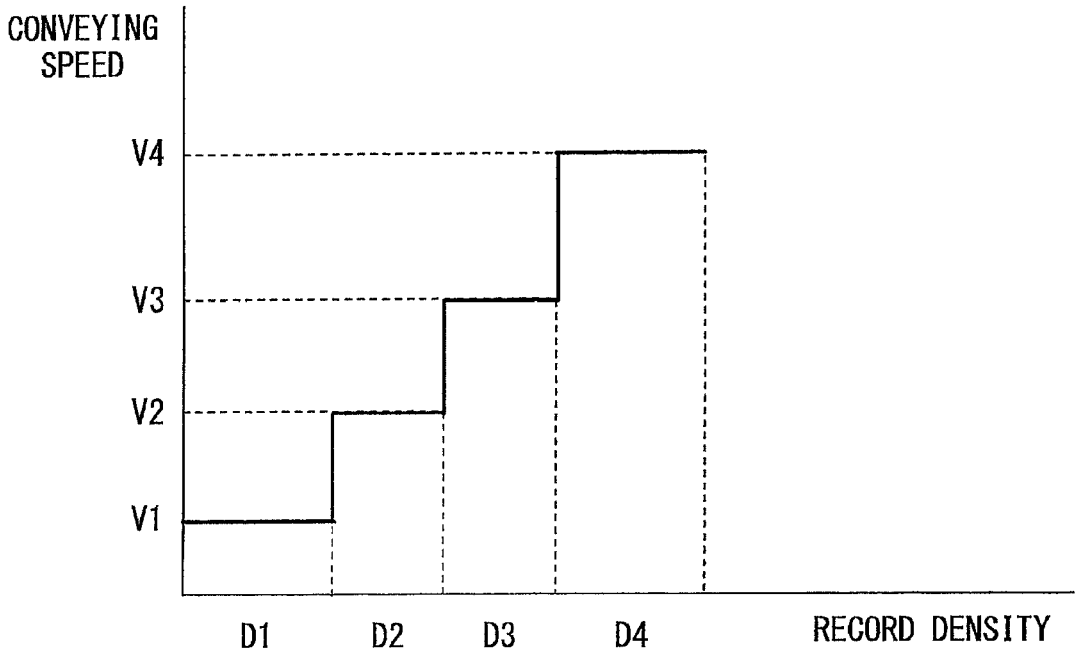
FIG. 4 illustrates the relationship between the conveying speed of a record medium and the record density of a test pattern.

FIG. 4 illustrates the relationship between the conveying speed of a record medium 11 and the record density of a test pattern.

FIG. 4 illustrates that the image of the test pattern is recorded at the record density of D1 (3 drops) when the conveying speed is V1, at the record density of D2 (4 drops) when the conveying speed is V2, at the record density of D2 (5 drops) when the conveying speed is V3, and at the record density of D4 (6 drops) when the conveying speed is V4

Thus, in the image recording apparatus 1 according to the present embodiment, the number of recording drops is variable depending on the conveying speed of the record medium 11. Thus, the problem of a record error being unclear and unable to be detected due to blurring of the test pattern by, for example, non-jetting of ink due to blocked nozzles or the like because a test pattern is recorded at a high record density when the conveying speed is low is prevented. Otherwise, the problem of a record error being unable to be detected due to a low record density because a test pattern is recorded at a low record density when the conveying speed is high is prevented. In addition, the problem of other parts of the record medium 11 or apparatus being contaminated by the saturation of the penetration of ink into the record medium 11 due to the high density of the test pattern is prevented.

The test pattern recorded by the first image recording unit 7 with the density varied depending on the conveying speed is read by the first detection unit 9 provided downstream in the conveyance direction, and the result is transferred to the record check unit 26. Similarly, the test pattern recorded by the second image recording unit 8 is read by the second detection unit 10, and the result is transferred to the record check unit 26.

If there is a no-jetting nozzle in the head nozzle, a portion on which no ink is jetted occurs in the direction parallel to the conveyance direction in the test pattern, that is, a white line occurs in the subscanning direction.

Figure 5A:
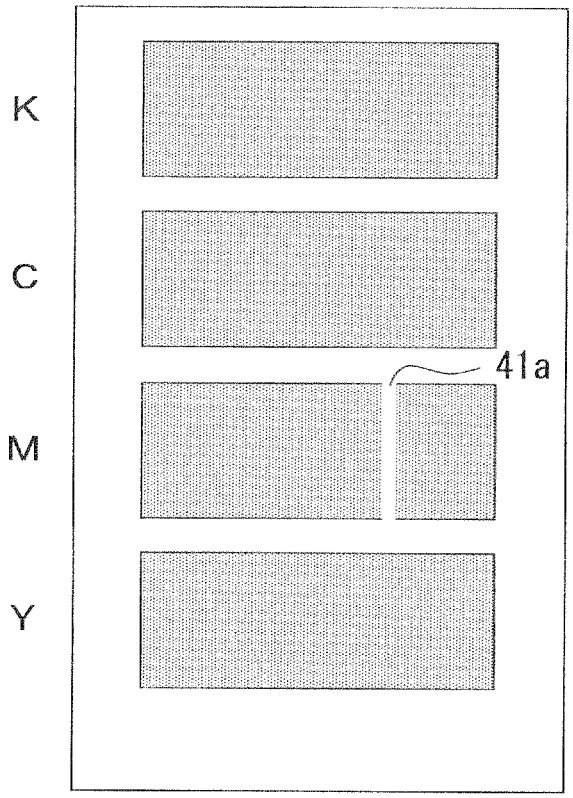
FIGS. 5A and 5B are examples of test patterns recorded by the image recording apparatus according to an embodiment of the present invention.
Figure 5B:
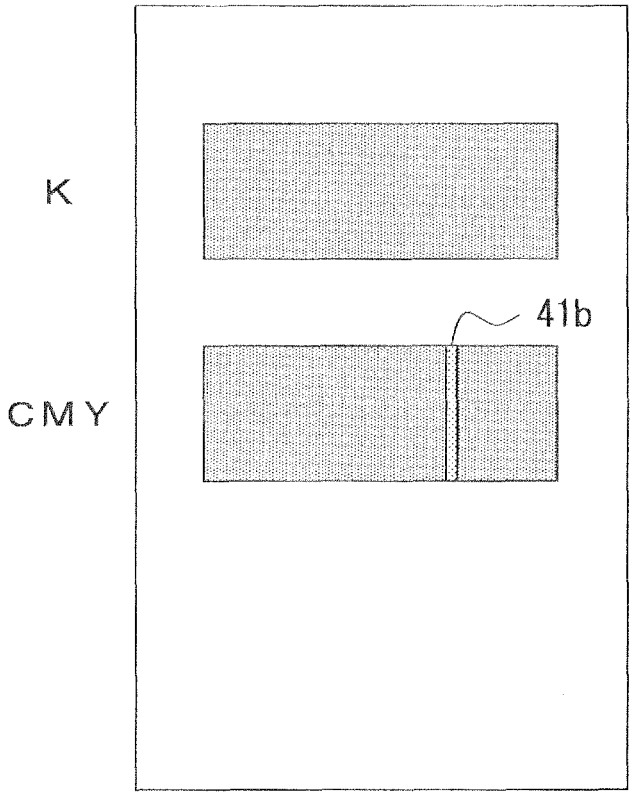

FIGS. 5A and 5B are examples of test patterns recorded by the image recording apparatus 1 according to the present embodiment.

FIG. 5A is an example of recording test patterns of sol id images in respective colors from among four colors, black (K), cyan (C), magenta (M), and yellow (Y). FIG. 5B is an example of a test pattern of a solid image in black (K) and a superposition of solid images in three colors.

In FIG. 5A, there is a blocked nozzle of magenta (M) resulting in a white line 41*a* as a record error due to a no-jetting nozzle. In FIG. 5B, there is also a blocked nozzle of magenta (M), resulting in a green line 41*b* as the combination of cyan (C) and yellow (Y) only, that is, a record error due to a no-jetting nozzle.

The record check unit 26 detects the presence/absence of a no-jetting nozzle by analyzing the image of the data output from the first detection unit 9 and the second detection unit 10.

Since a faulty image by a no-jetting nozzle appears in the subscanning direction in a test pattern, the difference in density depending on the number of drops has no influence on the detection of a fault.

If the record check unit 26 detects a record error in a test pattern, the informing unit 29 notifies a user by display or voice of the error. In this case, when the notification is issued, the conveyance of the record medium 11 may be stopped.

In addition, the configuration may be such that when a record error detecting process is performed during the decelerating operation for stopping the conveyance after the notification and a further record error is detected, the image recording apparatus 1 according to the present embodiment enters a mode in which a head nozzle cleaning process is performed.

Furthermore, the configuration may be such that, in the decelerating process for the conveying speed of the record medium 11 after the completion of the image recording process, a test pattern is similarly recorded and a record error is detected from the test pattern. If a record error is detected in this case, a user is notified that there is a possibility that an error of a white streak in the image recorded in the image recording process may occur.

Figure 6:
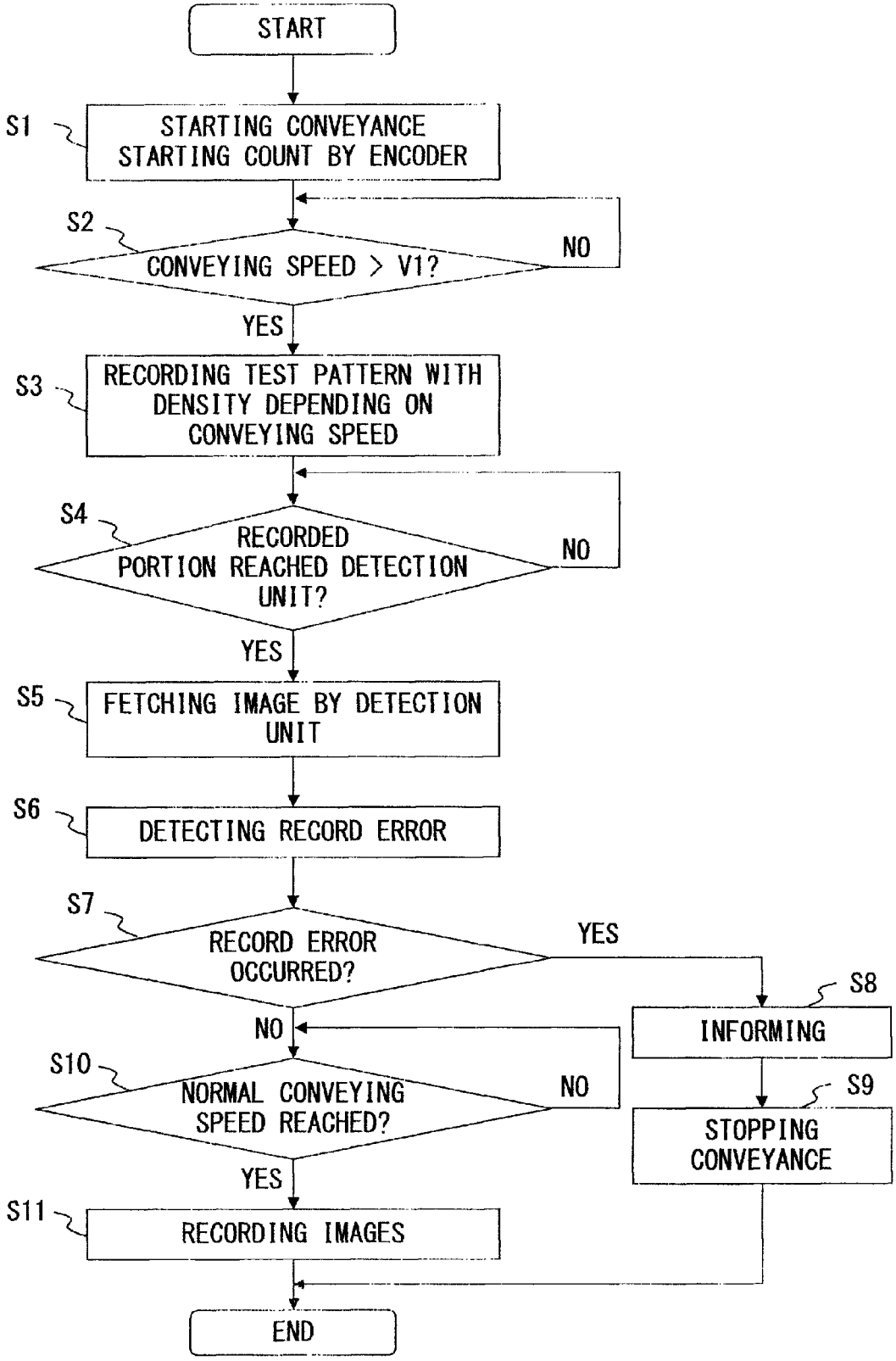
FIG. 6 is a flowchart of an operating process performed when an image recording apparatus 1 according to an embodiment of the present invention starts an image recording process.

FIG. 6 is a flowchart of an operating process performed when an image recording apparatus 1 according to an embodiment of the present invention starts an image recording process. The process in FIG. 6 is performed by the processor 27 of the control unit 30 executing the control program stored in the ROM.

The flowchart in FIG. 6 is commonly used for the combination of the first image recording unit 7 and the first detection unit 9 and the combination of the second image recording unit 8 and the second detection unit 10.

When the process in FIG. 6 is started, the control unit 30 first starts the conveyance of the record medium 11 in step S1, and simultaneously starts counting by the encoder 12. The control unit 30 can monitor the conveying speed of the record medium 11 by counting the number of pulses output by the encoder 12 in unit time.

Next, the control unit 30 monitors the output of the encoder 12, and waits for the conveying speed of the record medium 11 exceeding the recordable speed V1 of the test pattern (NO in Step S2).

If the conveying speed of the record medium 11 exceeds the recordable speed V11 of the test pattern in step S2 (YES in step S2), the control unit 30 records the test pattern on the record medium 11 with the density depending on the conveying speed in step S3. In this case, the record density of the test pattern is varied depending on the conveying speed.

Next, the control unit 30 determines in step S4 whether or not the test pattern recorded on the record medium 11 in step S3 has reached the first detection unit 9 and the second detection unit 10, and waits for it reaching the units (NO in step S4).

If the control unit 30 determines in step S4 that the test pattern has reached the first detection unit 9 and the second detection unit 10 (YES in step S4), then the control unit 30 reads the test pattern by the first detection unit 9 or the second detection unit 10 in step S5. Then, the control unit 30 receives the image data of the read test pattern.

The control unit 30 analyzes the image of the image data in step S6, and detects a record error in the test pattern. If a record error is detected as a result of the analysis (YES in step S7), the informing unit 29 notifies the user of the error in step S8, and stops conveying the record medium 11 in step S9.

If it determines in step S7 that there is no record error in the test pattern (NO in step S7), the control unit 30 waits for the conveying speed of the record medium 11 reaching the image recording speed V (NO in step S10). Then, if the conveying speed reaches the image recording speed V (YES in step S10), the control unit 30 records an image on the record medium 11 according to the job information from the upper device 24 (step S11).

Thus, the image recording apparatus 1 according to the present embodiment records a test pattern when the image recording process is started until the conveying speed of the record medium 11 reaches the image recording speed V, and determines whether or not there occurs a record error.

Therefore, the test pattern is recorded on the portion of the record medium that is to be conveyed until the conveying speed reaches the image recording speed V and is conventionally to be discarded, and it can be determined whether or not the test pattern includes a record error. Therefore, the record medium 11 to be wastefully conveyed can be suppressed. In addition, since a record error is detected before the image recording speed V is reached, the record medium 11 to be wastefully conveyed can be suppressed.

Furthermore, after the conveying speed of the record medium 11 reaches the image recording speed V, the image recording process can be immediately started based on the image data specified in the state in which no record error exists.

Figure 7:
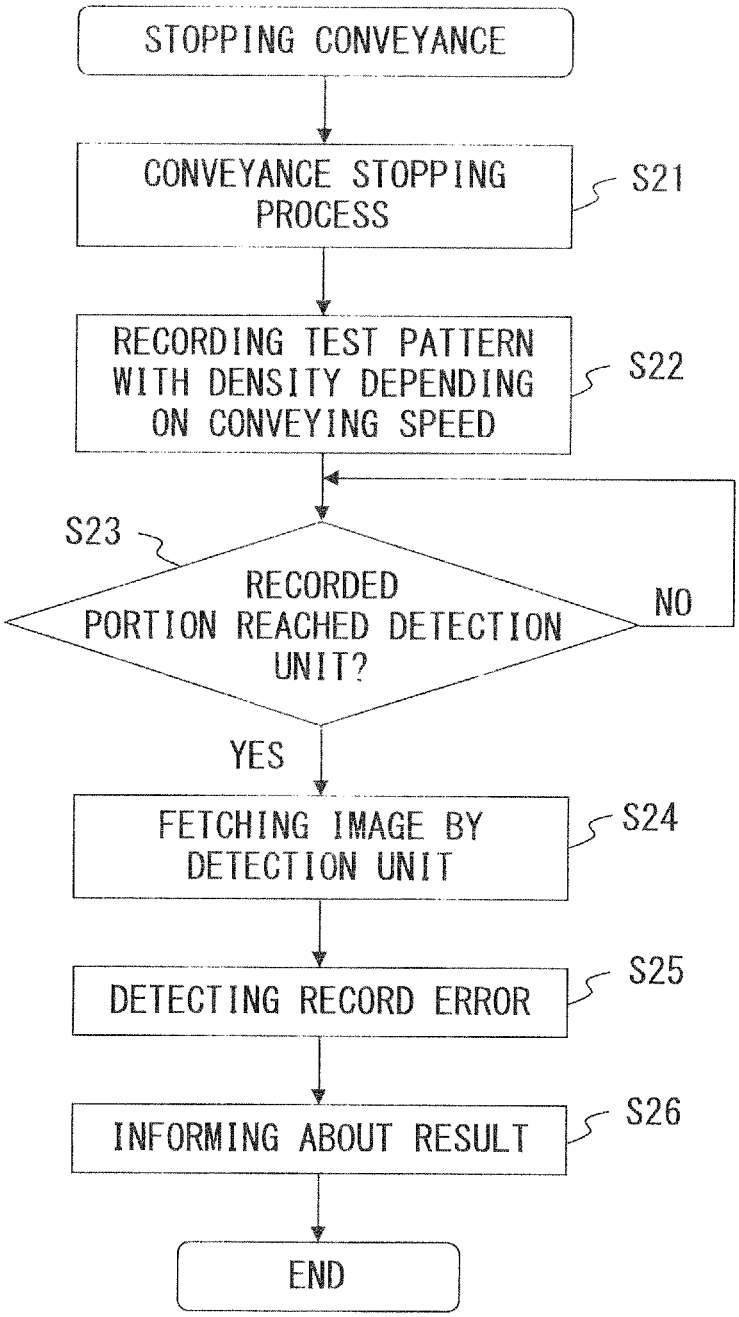
FIG. 7 is a flowchart of the process performed if a record error is detected when the conveyance of a record medium is stopped.

FIG. 7 is a flowchart of the process performed if a record error is detected when the conveyance of the record medium 11 is stopped.

The process is performed by the control unit 30 when the conveyance of the record medium 11 is stopped after completing the image recording process according to the job information from the upper device 24 or when the conveyance is stopped in step S9 as illustrated in FIG. 6.

When the process in FIG. 7 is started, the control unit 30 stops the conveyance of the record medium 11 in step S21. Since the record medium 11 and the conveyance system may have a great deal of inertia as described above, the conveyance cannot be stopped in a short time. Therefore, the conveying speed is gradually decreased, and during this decelerating period the record medium is also conveyed.

In this case, the control unit 30 records the test pattern on the conveyed record medium 11 with the record density depending on the conveying speed in step S22.

Then, the control unit 30 waits for the test pattern recorded in step S22 reaching the first detection unit 9 and the second detection unit 10 (NO in step S23). Then, if it is determined that the test pattern has reached the first detection unit 9 and the second detection unit 10 (YES in step S23), the control unit 30 reads the test pattern by the first detection unit 9 or the second detection unit 10 and acquires the image data in step S24.

The control unit 30 analyzes an image on the image data obtained in step S24, and detects a record error in the test pattern (step S25). Then, it notifies the user of the result (step S26), and terminates the process.

Thus, when the conveyance of the record medium 11 is stopped, a record error of a test pattern can be detected, thereby detecting whether or not an image recording process has been normally performed according to the job information from the upper device 24.

In addition, by also performing the process in FIG. 6, a fault such as a no-inkjet error etc. can be more correctly detected.

As described above, according to the image recording apparatus 1 of the present embodiment, an occurrence of waste paper can be suppressed on a record medium, and a normal image recording process can be performed immediately after the record medium reaches a specific conveying speed.

The image recording apparatus 1 according to the present embodiment is not limited to the image recording apparatus in the ink jet system, but can be applied in other recording systems such as a printer in an electrostatic system, a thermal transfer system, etc.

As described above, the embodiments according to the present invention have been described, but the present invention is not limited to the embodiments above, but can be improved and varied within the scope of the gist of the present invention. For example, some components may be deleted from the entire configuration proposed in each embodiment, and some different components of the above-mentioned embodiments may be appropriately combined.

What is claimed is:

1. An image recording apparatus which records an image on a continuous record medium based on job information from an upper device, comprising:

an image recording unit recording a test pattern on the continuous record medium in at least one of a period when a conveying speed of the continuous record medium is accelerated until the conveying speed reaches a constant speed and a period when the conveying speed is decelerated to stop conveying the continuous record medium;

a detection unit reading the test pattern; and a record check unit determining whether or not there is a record error detected in the test pattern read by the detection unit.

2. The image recording apparatus according to claim 1, further comprising an image recording control unit changing record density based on the conveying speed when the image recording unit records the test pattern.

3. The image recording apparatus according to claim 2, wherein the image recording control unit increases the record density when the conveying speed is high, and decreases the record density when the conveying speed is low.

4. The image recording apparatus according to claim 1, further comprising an informing unit informing that the record error is detected when the record check unit determines that there is the record error in the test pattern.

5. The image recording apparatus according to claim 1, wherein when the image recording unit records the test pattern on the continuous record medium while accelerating the conveying speed, the record check unit stops conveying the continuous record medium if it is determined that there is the record error in the test pattern read by the detection unit.

6. The image recording apparatus according to claim 1 wherein the image recording unit jets ink on the continuous record medium and records the test pattern, and the record error is a no ink jet portion.

7. The image recording apparatus according to claim 1, wherein the image recording unit records the test pattern on a front and a reverse of the continuous record medium, and the detection unit reads the test patterns on the front and the reverse.

8. The image recording apparatus according to claim 1, further comprising a cutting unit cutting the continuous record medium according to the job information.

9. The image recording apparatus according to claim 1, wherein when the image recording unit records the test pattern on the continuous record medium in an accelerating period in which the conveying speed is accelerated, the determination unit makes a determination during the accelerating period.

10. The image recording apparatus according to claim 1, wherein when the image is recorded using a plurality of colors, the test patterns are solid images of respective colors.

11. The image recording apparatus according to claim 1, wherein when the image is recorded using a plurality of colors, the test patterns are a solid image of black and a superposition of solid images of colors other than black.

12. A method of controlling an image recording apparatus which records an image on a continuous record medium based on job information from an upper device, comprising:

recording a test pattern on the continuous record medium in at least one of a period when a conveying speed of the continuous record medium is accelerated until the conveying speed reaches a constant speed and a period when the conveying speed is decelerated to stop conveying the continuous record medium;

reading the test pattern; and determining whether or not there is a record error detected in the read test pattern.

13. The method according to claim 12, wherein when the test pattern is recorded, record density is changed based on the conveying speed.

* * * * *